US010857059B1

(12) United States Patent
Irsay

(10) Patent No.: US 10,857,059 B1
(45) Date of Patent: Dec. 8, 2020

(54) WALKER WITH A VERTICAL EXTENSION FOR ASSISTING A USER IN MOVING FROM A WALKING POSITION TO A MORE-ERECT POSITION

(71) Applicant: James S. Irsay, Carmel, IN (US)

(72) Inventor: James S. Irsay, Carmel, IN (US)

( * ) Notice: Subject to any disclaimer, the term of this patent is extended or adjusted under 35 U.S.C. 154(b) by 0 days.

(21) Appl. No.: 16/897,066

(22) Filed: Jun. 9, 2020

(51) Int. Cl.
*A61H 3/04* (2006.01)
*A61G 5/14* (2006.01)

(52) U.S. Cl.
CPC ..... *A61H 3/04* (2013.01); *A61G 5/14* (2013.01); *A61H 2003/046* (2013.01); *A61H 2201/0192* (2013.01); *A61H 2201/1633* (2013.01); *A61H 2201/1638* (2013.01)

(58) Field of Classification Search
CPC ..... A61H 3/04; A61H 2003/046; A61H 2201/1638; A61H 2201/1635; A61G 5/14
USPC ..... 135/67; 5/81.1 R; 482/66–68; 280/87.021, 87.041, 87.05, 657; 297/5
See application file for complete search history.

(56) References Cited

U.S. PATENT DOCUMENTS 1,307,058 A * 6/1919 McGrath ..... A61H 3/04 297/5
2,621,707 A * 12/1952 Butler ..... A61H 3/04 482/67
2,745,465 A * 5/1956 Hogan ..... A61H 3/04 297/6
3,249,368 A * 5/1966 Ginzburg ..... A61G 7/1038 280/219
3,591,874 A * 7/1971 O'Kennedy ..... A61G 7/1074 5/171
3,604,019 A * 9/1971 Garner ..... A47K 3/003 4/576.1
4,187,869 A * 2/1980 Marchetti ..... A61H 3/04 135/67
4,226,413 A * 10/1980 Daugherty ..... A61H 3/04 188/1.12
4,341,381 A * 7/1982 Norberg ..... A61H 3/04 135/67
4,355,701 A * 10/1982 Nicholson ..... B63B 27/146 182/100
4,411,283 A * 10/1983 Lucarelli ..... A61H 3/00 135/67

(Continued)

FOREIGN PATENT DOCUMENTS

CA 2368086 A1 * 11/2000 ..... A61H 3/04
FR 1451430 A * 1/1966 ..... A61H 3/04
WO WO-9429156 A1 * 12/1994 ..... B62B 1/12

OTHER PUBLICATIONS 3 page PDF of machine translation of FR 1,451,430. (Year: 1966).*

(Continued)

*Primary Examiner* — Robert Canfield
(74) *Attorney, Agent, or Firm* — Brinks Gilson & Lione

(57) ABSTRACT

A walker with a vertical extension for assisting a user in moving from a walking position to a more-erect position is provided. In one embodiment, the vertical extension has secondary hand grips that can assist a user in standing more erect after being in a hunched-over position while using the walker. For example, the plurality of secondary hand grips can be arranged along the vertical extension to allow a user to climb the plurality of secondary hand grips to progressively stand more erect.

16 Claims, 12 Drawing Sheets

(56) References Cited

U.S. PATENT DOCUMENTS 4,474,202 A * 10/1984 Blechner ..... A61H 3/00 135/67
4,620,714 A * 11/1986 Davis ..... A61G 5/00 280/208
4,765,355 A * 8/1988 Kent ..... A61H 3/04 135/67
5,785,070 A * 7/1998 Block ..... A45B 9/00 135/65
5,983,911 A * 11/1999 Steele ..... A61G 5/1094 135/66
6,044,507 A * 4/2000 Smith ..... A61G 7/1038 248/158
6,308,981 B1 * 10/2001 Proehl ..... A61G 7/1017 280/47.34
6,733,018 B2 5/2004 Razon
6,743,156 B1 * 6/2004 Jacques, II ..... A61H 3/04 135/65
7,275,554 B2 * 10/2007 Mullholand ..... A61H 3/008 135/67
8,166,987 B2 * 5/2012 Weaver ..... A61G 5/14 135/67
8,234,755 B1 8/2012 Brand et al.
8,540,256 B1 * 9/2013 Simpson ..... A61H 3/00 135/67
8,714,171 B1 5/2014 Haygood
8,794,252 B2 8/2014 Alghazi
9,022,397 B1 * 5/2015 Prettyman ..... B62B 5/0447 280/47.34
9,149,408 B2 10/2015 Karlovich
9,198,823 B1 * 12/2015 Whited ..... A61H 3/04
9,351,898 B2 5/2016 Triolo et al.
9,566,207 B1 2/2017 Ratliff
9,585,807 B2 3/2017 Fellingham et al.
9,597,251 B2 3/2017 Liles et al.
9,833,377 B2 * 12/2017 Smed ..... A61H 3/04
10,085,909 B2 10/2018 Fellingham et al.
10,092,475 B2 10/2018 Smith
10,307,321 B2 6/2019 Pan et al.
10,322,056 B2 6/2019 Fellingham et al.
10,413,471 B2 9/2019 Marom
10,434,031 B2 10/2019 Pan et al.
10,507,152 B2 12/2019 Afshani
10,555,866 B2 2/2020 Pan et al.
10,583,065 B1 * 3/2020 Mejia ..... A61H 3/04
10,588,815 B2 3/2020 Fellingham et al.
10,617,592 B2 4/2020 Fellingham et al.
2003/0078146 A1 * 4/2003 Wideman ..... A61H 1/0244 482/148
2004/0201191 A1 * 10/2004 Jacques, II ..... A61H 3/04 280/87.01
2006/0096626 A1 * 5/2006 Weaver ..... A61H 3/00 135/67
2006/0272090 A1 * 12/2006 Woodward ..... A61G 7/1038 5/86.1
2007/0262619 A1 * 11/2007 Blemel ..... A47C 16/04 297/5
2008/0312051 A1 * 12/2008 Manyseng ..... A63B 9/00 482/92
2009/0283360 A1 * 11/2009 Eckerdt ..... A61G 7/053 182/100
2013/0319488 A1 * 12/2013 Chiu ..... A61H 3/00 135/67
2015/0090308 A1 * 4/2015 Bos ..... A61H 3/04 135/67
2017/0209319 A1 7/2017 Fawcett et al.
2017/0258664 A1 9/2017 Purcell
2019/0240106 A1 * 8/2019 Kapec ..... A61H 3/04
2019/0254895 A1 * 8/2019 Afshani ..... A61G 5/14
2020/0008990 A1 1/2020 Harrison

OTHER PUBLICATIONS

UPWalker® Patent and Trademark Information; LifeWalker Mobility Products Patents and Trademarks; webpage downloaded from the Internet at https://www.lifewalker.us/patents-and-trademarks on May 27, 2020; 3 pages.

Elenker Upright Walker, Stand Up folding Rollator Walker Back Erect Rolling Mobility Walking Aid with Backrest Seat and Padded Armrests for Seniors and Adults, Red; Amazon product page; downloaded from the Internet at https://www.amazon.com/ELENKER-Upright-Walker-Folding-Rollator/dp/B07KN15BTR on Mar. 4, 2020; 9 pages.

The Next Step Forward in Mobility: The design of the LifeWalker Upright includes features that provide benefits not available in current walkers; LifeWalker Mobility Products—About the LifeWalker Upright product page; downloaded from the Internet at https://www.lifewalker.us/why-the-lifewalker-upright on Mar. 4, 2020; 3 pages.

Buy UPWalker Walking Aid—Upright Walker / Stand Up Walker; Products for You product page; downloaded from the Internet at https://www.healthproductsforyou.com/p-the-upright-upwalker.html on Mar. 4, 2020; 6 pages.

Medline Stand & Go Walker for Seniors, Premium 2-in-1 Stand Assist Walker with Wheels and Glides, Blue Frame (MDS86410SGB) by Medline; Amazon product page; downloaded from the Internet at https://www.amazon.com/Medline-Walker-Seniors-Premium-MDS86410SGB/dp/B07WN6D3LX on Mar. 4, 2020; 7 pages.

* cited by examiner

WALKER WITH A VERTICAL EXTENSION FOR ASSISTING A USER IN MOVING FROM A WALKING POSITION TO A MORE-ERECT POSITION

BACKGROUND

A walker is a mobility-assistance device that provides a user experiencing a mobility problem with support to maintain balance and stability while walking. Some or all of the legs of the walker can have wheels or glides to assist in mobility. A walker can take the form of a simple frame or can have various accessories, such as a built-in seat, hand brakes, and a basket. A typical walker has height-adjustable hand grips that a user holds while walking; however, a user may be slightly bent over when using the walker. Some walkers have upper and lower pairs of hand grips. The upper pair is positioned alongside armrests and is positioned high enough that a user can stand fully erect while walking. As those hand grips would typically be too high for a user to grab from a seated position, such walkers can have a lower pair of non-adjustable hand grips that a user can use to assist in moving from a seated position to a walking position. As the lower pair of hand grips is intended to be used merely as an aid to getting up from a seated position and not for walking, hand brakes are not provided on the lower pair of hand grips.

DETAILED DESCRIPTION

Figure 1:
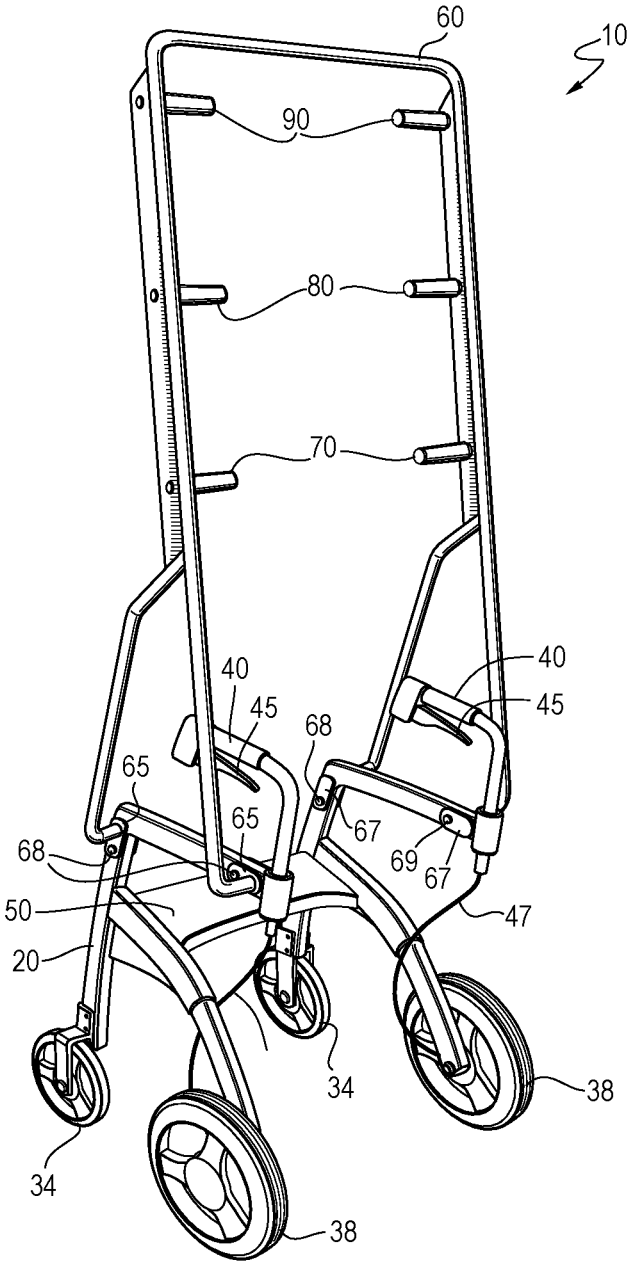
FIG. 1 is a perspective view of a walker with a vertical extension of an embodiment.
Figure 2:
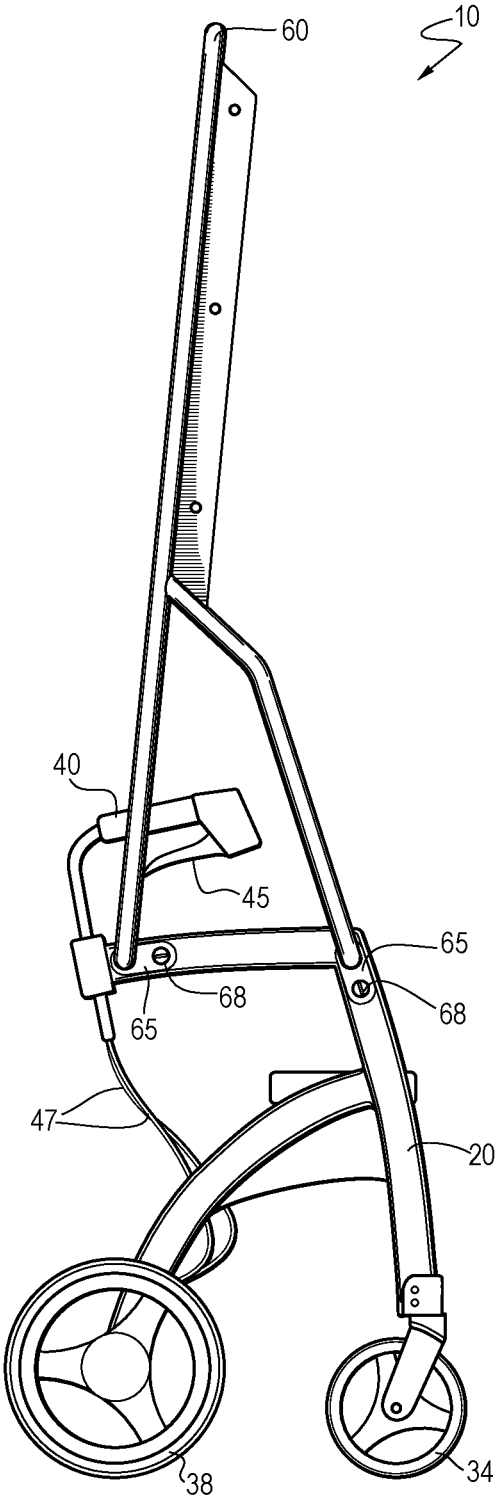
FIG. 2 is a right side view of the walker shown in FIG. 1.

By way of introduction, the below embodiments provide a walker with a vertical extension for assisting a user in moving from a walking position to a more-erect position. The vertical extension can be packaged together with the walker, such that the vertical extension and the walker are provided together to an end user (e.g., at the time of sale). In such a situation, the vertical extension can be integrated with or removably coupled with the walker (e.g., by the manufacturer, by a salesman, or by the end user). Alternatively, the vertical extension can be an accessory for an existing walker that can be purchased at the time of sale of the walker or later and coupled with the walker thereafter.

Turning now to the drawings, FIGS. 1-6 show various views of a walker 10 of one embodiment. It should be understood that this is merely one implementation and other implementations can be used. As shown in the drawings, in this embodiment, the walker 10 comprises a frame 20 that carries several components found on typical walkers. More specifically, the frame 20 carries two rear wheels 34 and two larger front wheels 38, a pair of height-adjustable primary hand grips 40, each with a hand brake 45 coupled with a brake line 47, and a seat 50. The pair of hand grips 40 is referred to as the "primary" hand grips 40 because these are the hand grips that a user would use as he is walking with the walker 10. As such, the hand brakes 45 are arranged with the primary hand grips 40. It should be noted that various walkers can have different components, so the components, shapes, and arrangements shown in these drawings are not necessarily required. For example, some walkers may only have front wheels (and no rear wheels), while other walkers may not have any wheels at all. Also, some walkers may not have a seat or brakes but may have other components not shown in these drawings. Accordingly, the term "walker" as used herein generally refers to a mobility-assistance device and does not require any specific components shown or described herein.

In this embodiment, a vertical extension 60 is coupled with the frame 20 of the walker 10. As used herein, the phrase "coupled with" can mean directly coupled with or indirectly coupled with through one or more components, named or unnamed herein. Here, the vertical extension 60 is removably coupled with the frame 20 via an attachment mechanism. In this embodiment, the attachment mechanism comprises front and rear plates 65, 67 that mount to either side of left and right arms of the frame 20 and are secured by a bolt 68 and nut 69. Of course, this is just one particular example of an attachment mechanism, and other types of attachment mechanisms can be used. Also, as noted above, in other embodiments, the vertical extension 60 can be integrated with the frame 20 (such as when both components are manufactured together or are separate components that are welded, glued, or otherwise secured in a permanent or semi-permanent basis).

In this embodiment, the vertical extension 60 comprises a structure with two sides and a top that generally form an upside-down U-shape, which provide stability to the vertical extension 60 when it is used by a user. A plurality of pairs of secondary hand grips 70, 80, 90 positioned along the two sides of the structure above the primary hand grips 40. These hand grips 70, 80, 90 are referred to as "secondary" because they would not typically be used by a user as he is walking with the walker 10. Because of this, the hand brakes 45 are arranged with the primary hand grips 40 and not with the secondary hand grips 70, 80, 90. Some or all of the secondary hand grips 70, 80, 90 can be at fixed positions or by height adjustable.

Figure 3A:
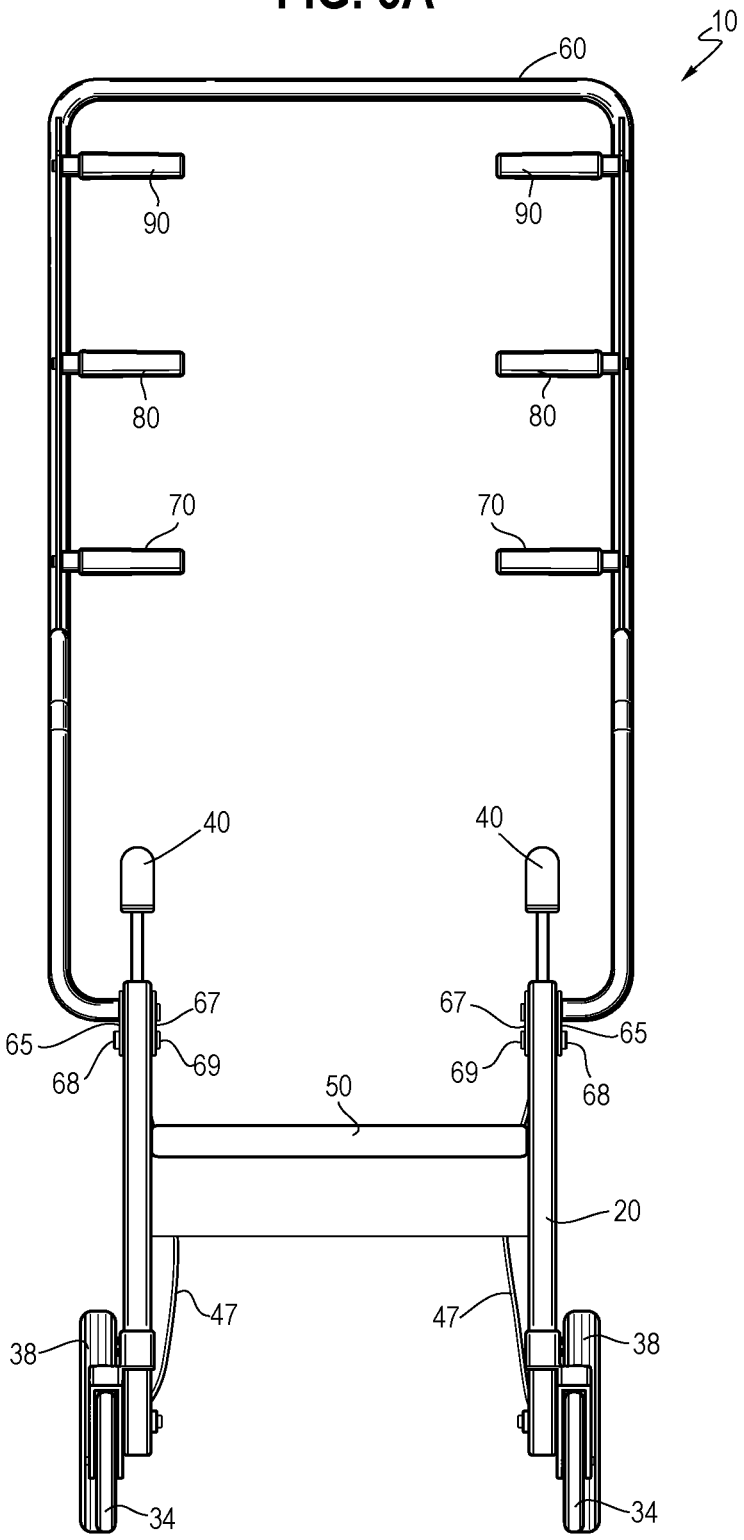
FIG. 3A is a rear view of the walker shown in FIG. 1.
Figure 3B:
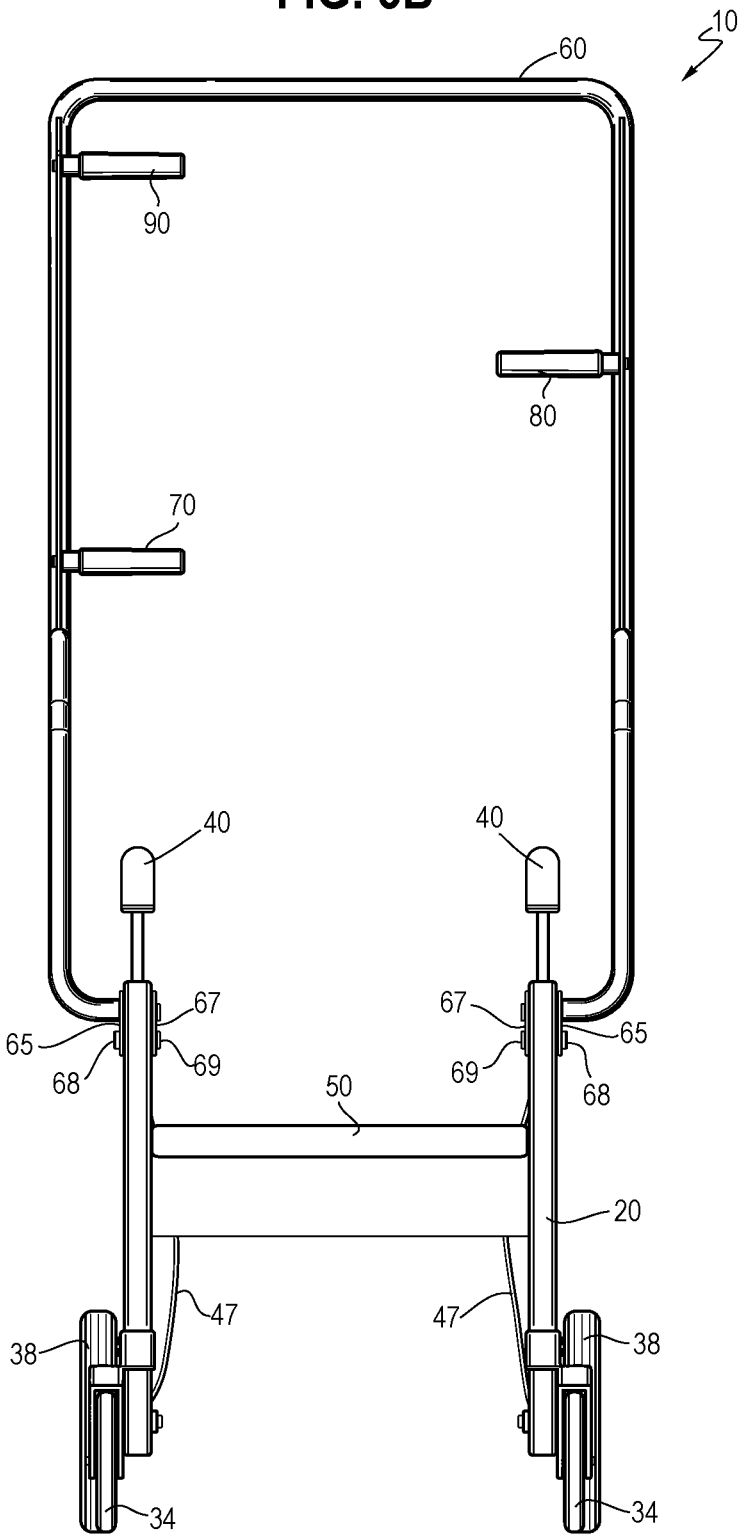
FIG. 3B shows an embodiment in which each of the plurality of secondary hand grips is in a different horizontal plane.
Figure 4:
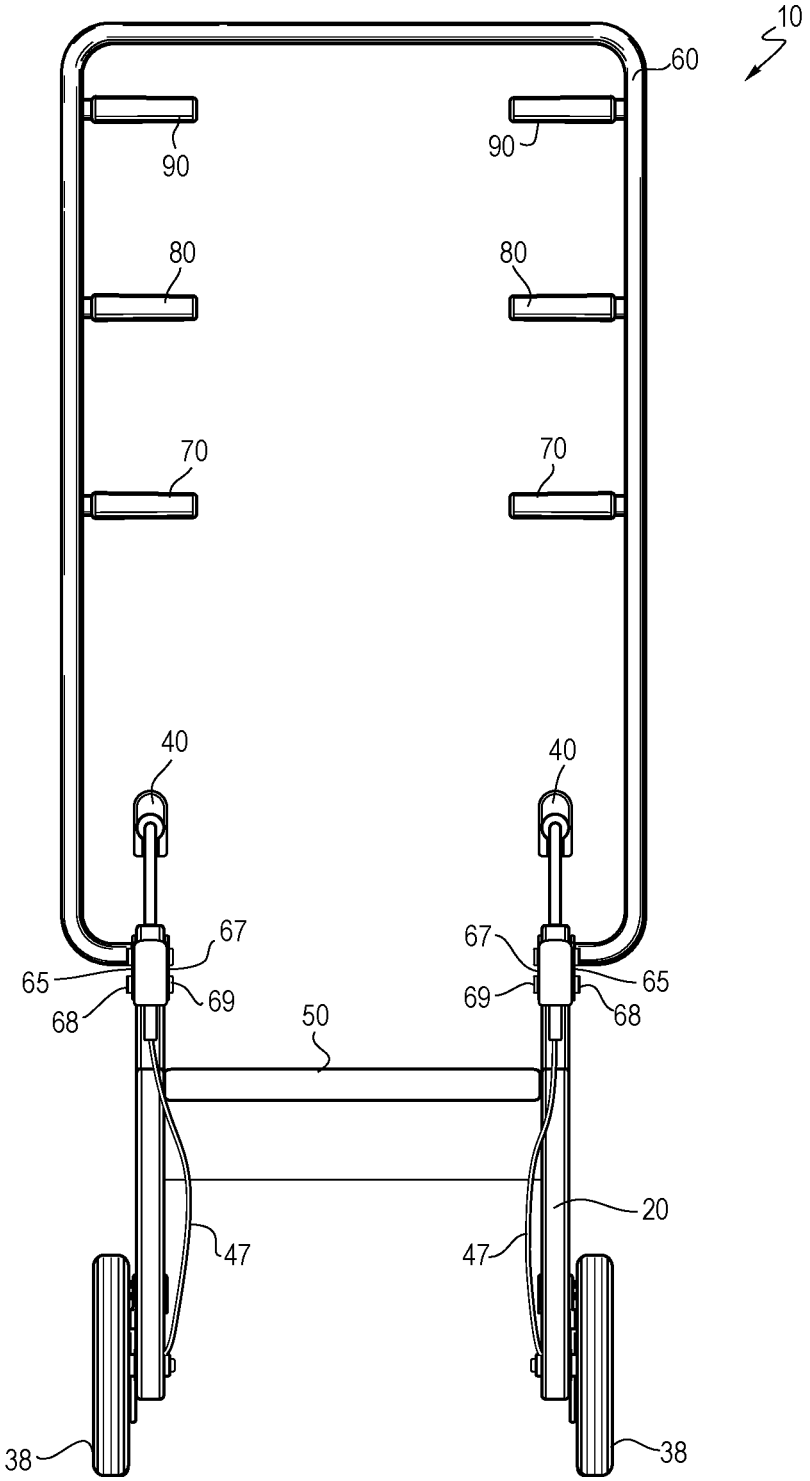
FIG. 4 is a front view of the walker shown in FIG. 1.
Figure 5:
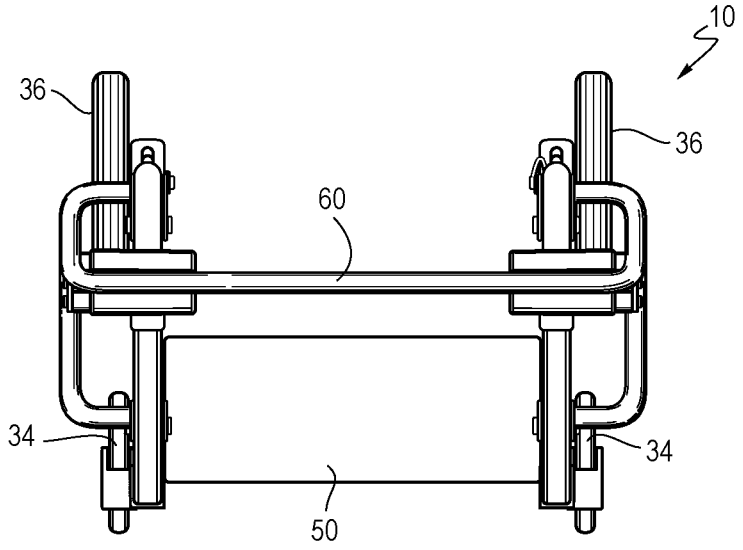
FIG. 5 is a top view of the walker shown in FIG. 1.
Figure 6:
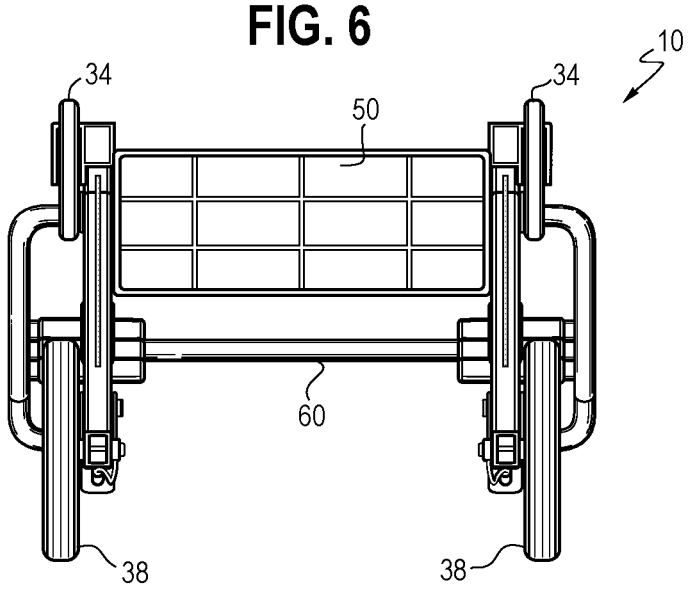
FIG. 6 is a bottom view of the walker shown in FIG. 1.
Figure 7:
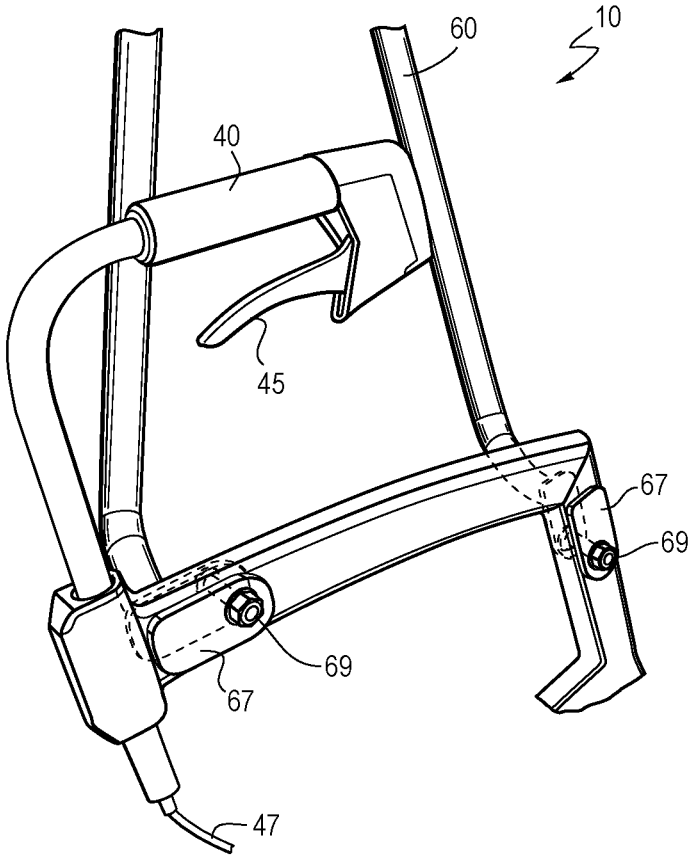
FIG. 7 is a view of an attachment mechanism for the vertical extension of the walker in FIG. 1.

Here, the plurality of secondary hand grips 70, 80, 90 takes the form of a plurality of parallel pairs of hand grips (i.e., two secondary hand grips in the same horizontal plane) arranged along the vertical extension 60 to allow a user to climb the plurality of secondary hand grips to progressively stand more upright. It should be understood that the plurality of secondary hand grips can be arranged in any suitable fashion. For example, the secondary hand grips can be arranged in a staggered (instead of parallel) manner (i.e., only one secondary hand grip in a horizontal plane), as shown in FIG. 3B. Also, it should be understood that a secondary hand grip is positioned "above" the primary hand grips when the secondary hand grip is directly above (i.e., in the same vertical plane as) or indirectly above (i.e., in a different vertical plane as) the primary hand grips 40. Also, the number of secondary hang grips can vary and be more than or fewer than what is shown in the drawings.

Figure 8:
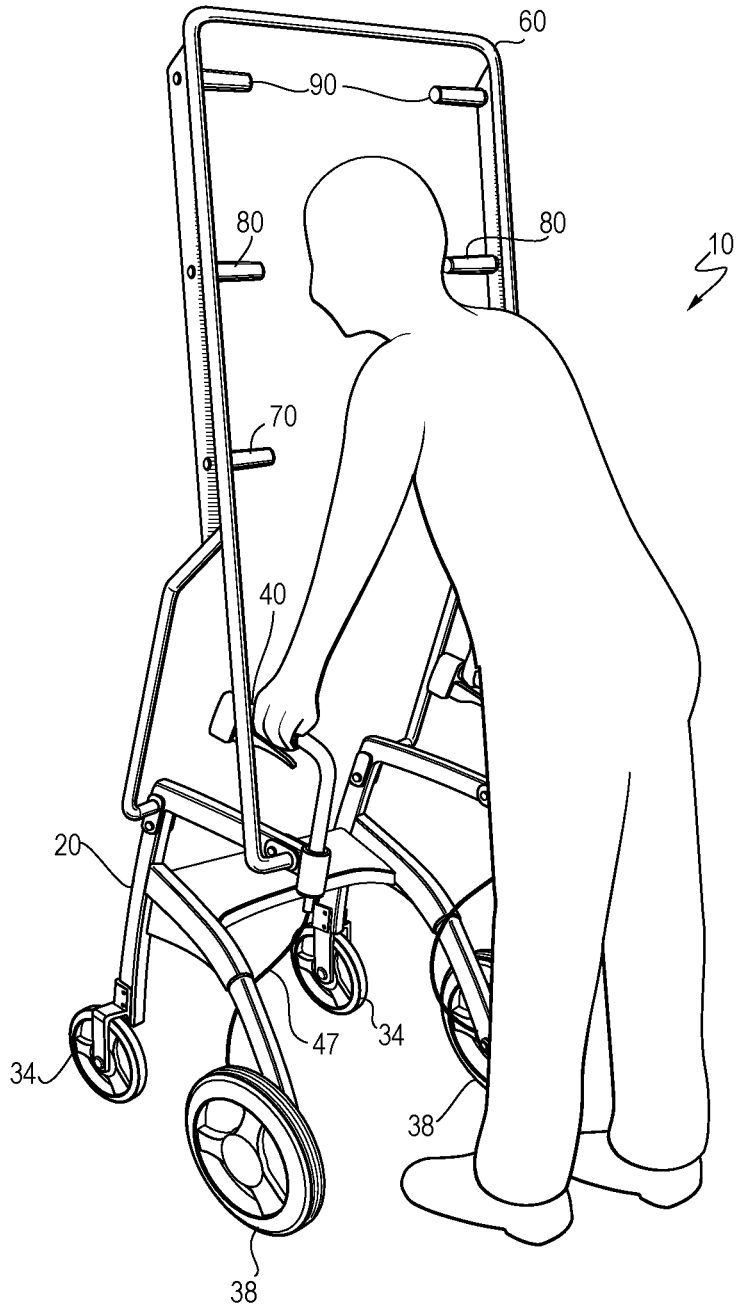
FIG. 8 is a perspective view of the walker in FIG. 1 being used by a user.

Returning to the drawings, FIG. 8 shows the walker 10 being used by a user. As shown in FIG. 8, the user is slightly hunched over when using the walker 10. For some users, it may be difficult to stand more erect after being in a hunched-over position for a period of time. For example, a user's back muscles may tighten while being hunched over, creating a resistance to the user standing more erect. As shown in FIGS. 9-12, the vertical extension 60 of these embodiments can assist the user in moving from the hunched-over walking position to a more-erect position. The term "more erect" is used instead of "erect" as it is recognized that, for some users, it may be very difficult or impossible for them to stand completely erect.

Figure 9:
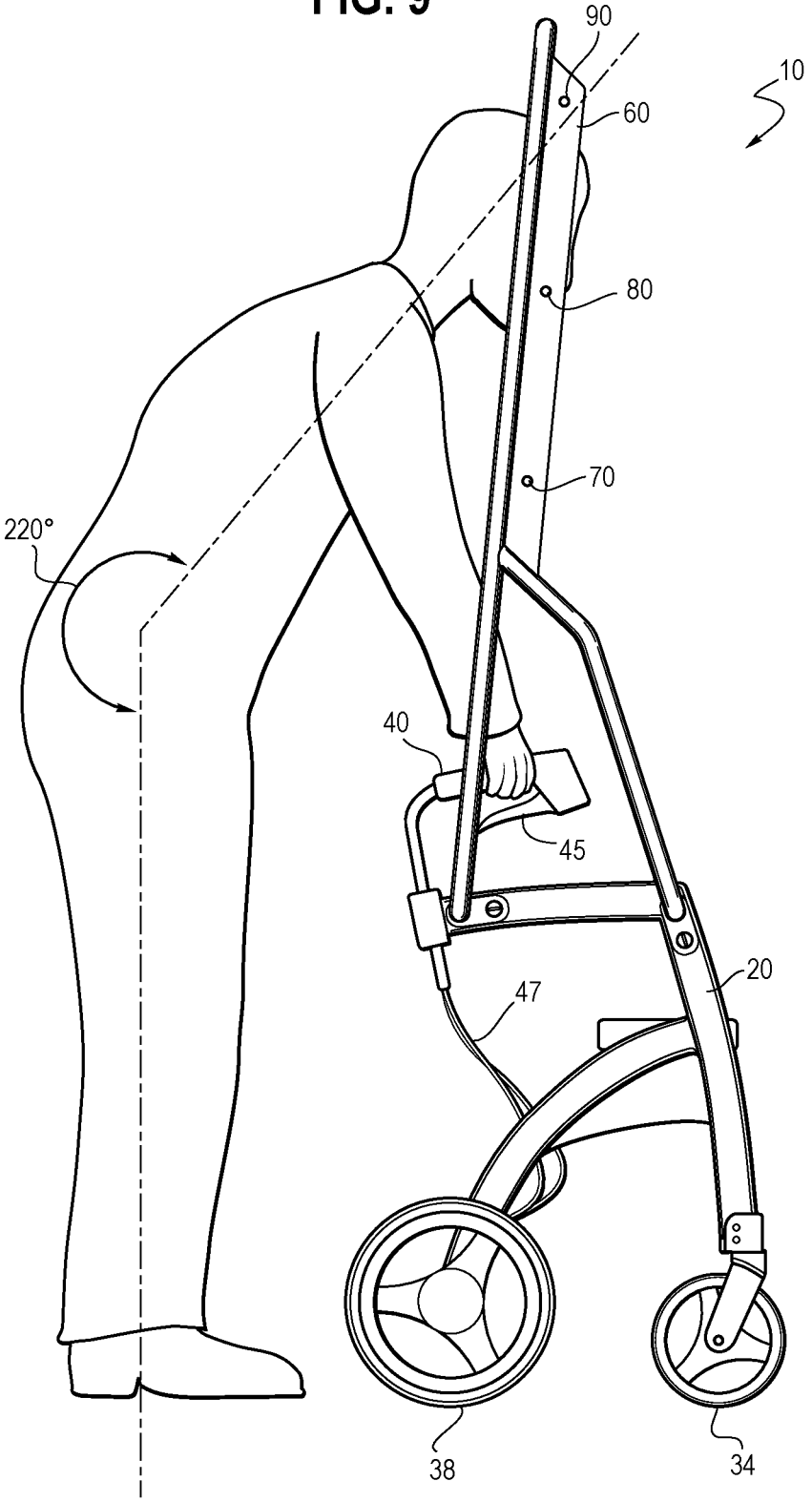
FIG. 9 is a right side view of the walker in FIG. 1 with a user gripping the primary hand grips.
Figure 10:
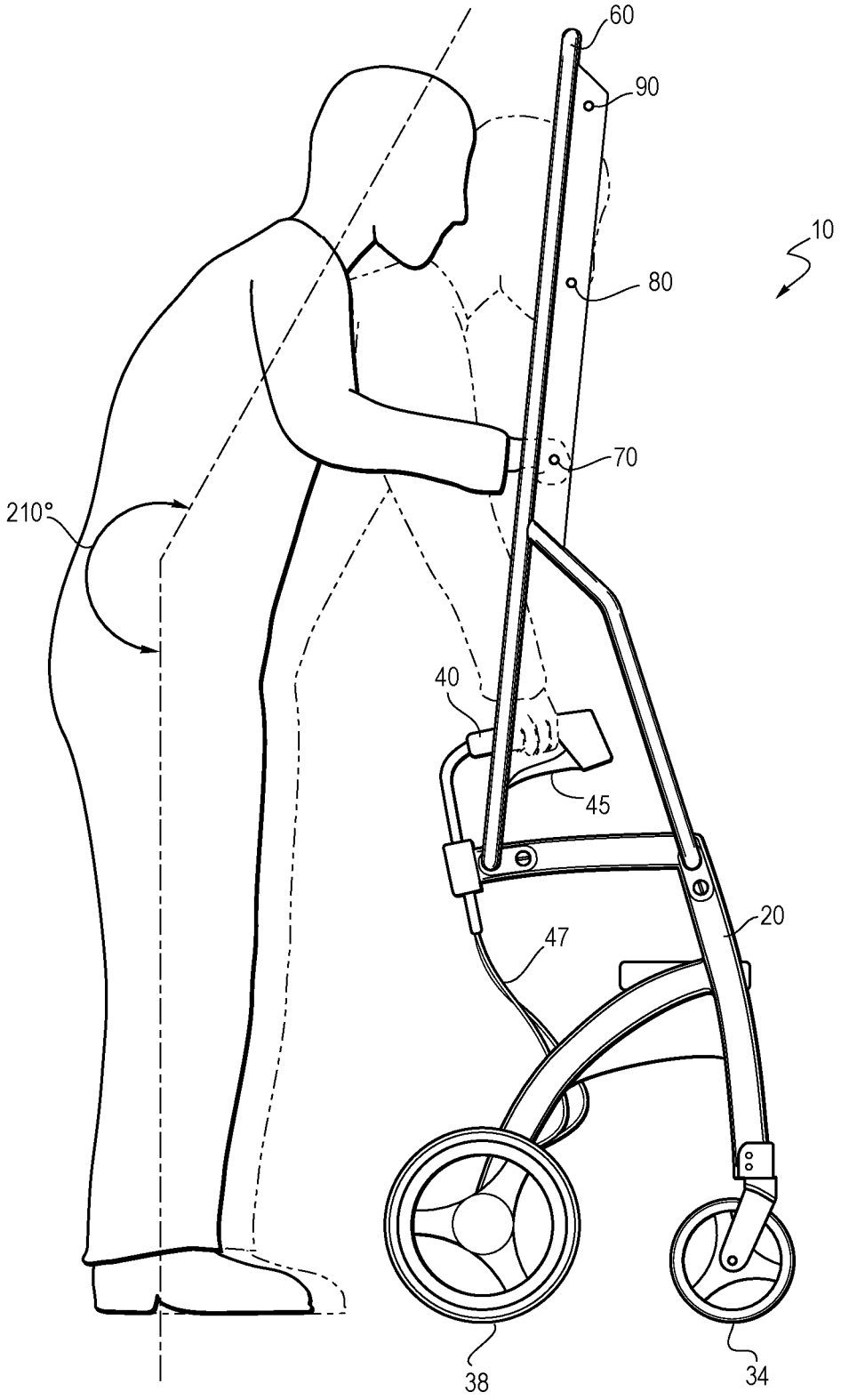
FIG. 10 is a right side view of the walker in FIG. 1 with a user gripping a first pair of secondary hand grips in the vertical extension.
Figure 11:
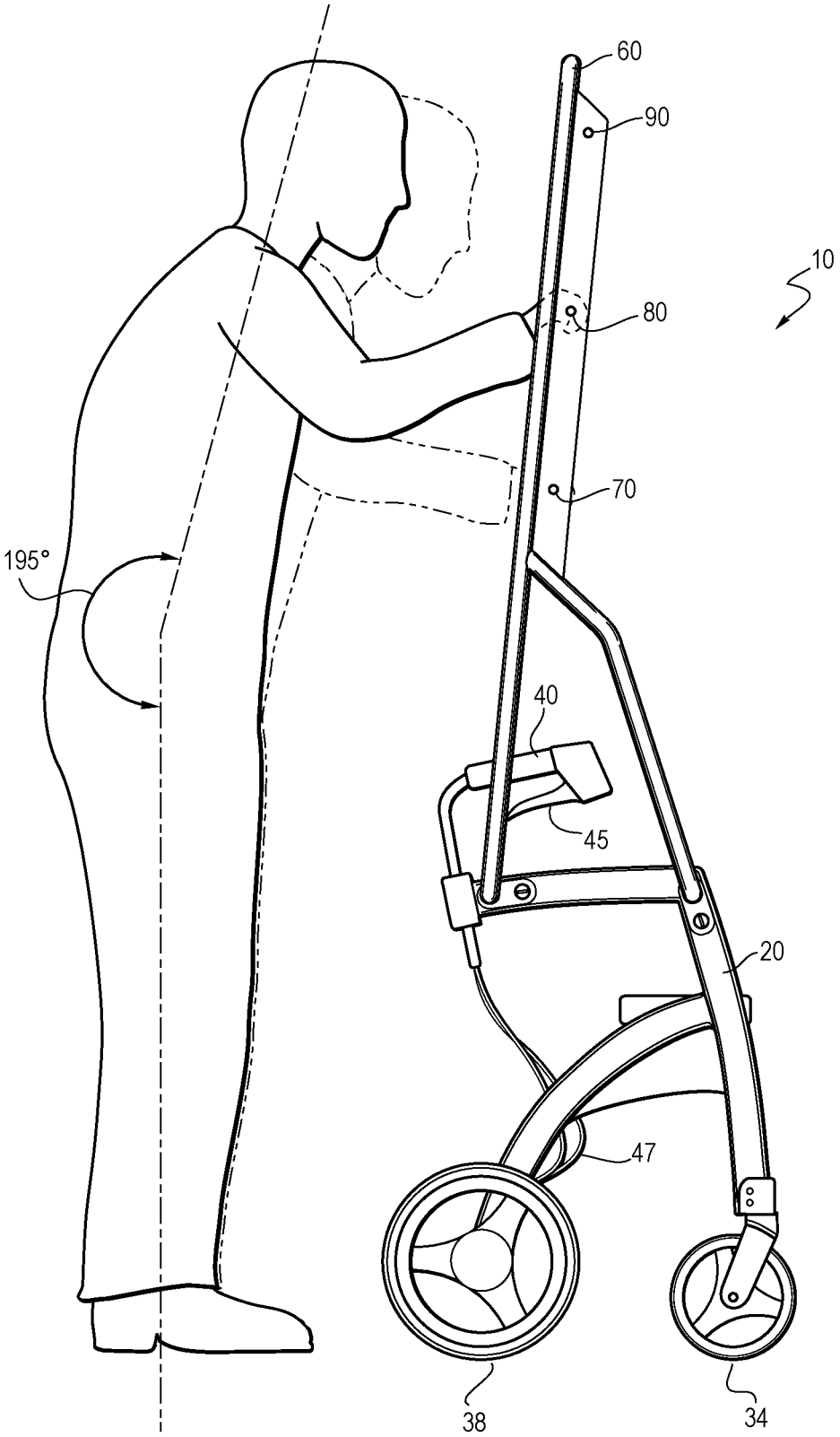
FIG. 11 is a right side view of the walker in FIG. 1 with a user gripping a second pair of secondary hand grips in the vertical extension.
Figure 12:
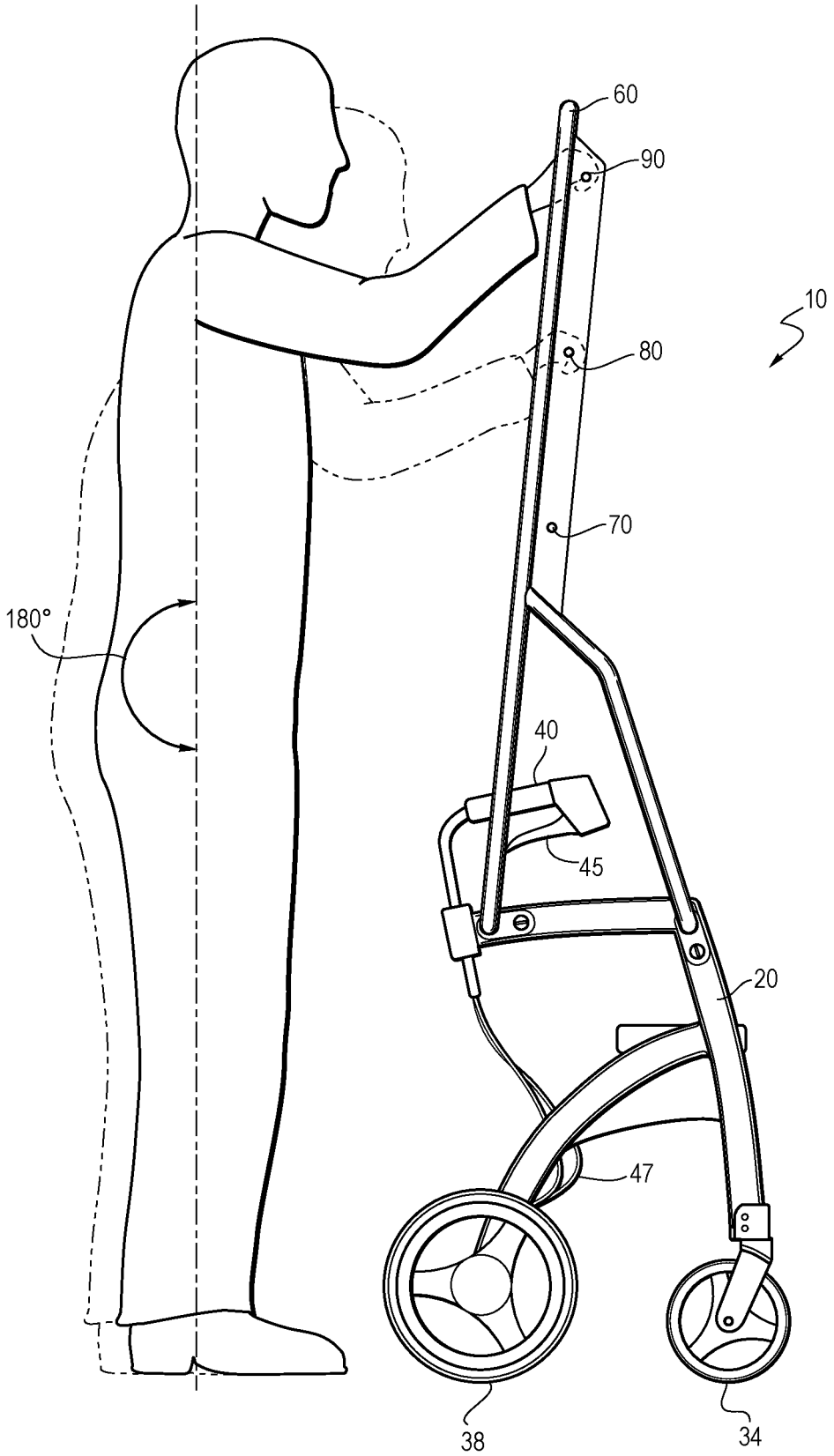
FIG. 12 is a right side view of the walker in FIG. 1 with a user gripping a third pair of secondary hand grips in the vertical extension.

In FIG. 9, the user is shown in the hunched-over walking position, holding onto the primary pair of hand grips 40. In this position, the user is angled about 220 degrees (this and the below measurements are used merely for illustration purposes and may not be the actual angles encountered by users). To assist the user in moving from the hunched-over walking position to a more-erect position, the user can "climb" the secondary hand grips on the vertical extension 60. FIGS. 10-12 show that when the user "climbs" the first, second, and third pairs of secondary hand grips 70, 80, 90, respectively, the user is able to stand more and more erect. In this example, the angle at which the user is hunched over progressively decreases from 220 degrees to 210 degrees to 195 degrees and then to 180 degrees as the user "climbs" the first, second, and third pairs of secondary hand grips 70, 80, 90.

As noted above, some prior walkers have upper and lower pairs of hand grips. However, the lower pair of hand grips in prior walkers is used merely to assist a user from moving from a seated position to a walking position, and the upper pair of hand grips is used for walking (which is why the hand brakes are arranged next to the upper pair of hand grips instead of the lower pair of hand grips). In contrast, with the walker 10 of this embodiment, the lower pair of hand grips 40 is used for walking (which is why the hand brakes 45 are arranged next to them), and the upper pairs 70, 80, 90 are used to assist a user from moving from a walking position to a more-erect position (not from a seated position to a walking position).

It is intended that the foregoing detailed description be understood as an illustration of selected forms that the invention can take and not as a definition of the invention. It is only the following claims, including all equivalents, that are intended to define the scope of the claimed invention. Finally, it should be noted that any aspect of any of the embodiments described herein can be used alone or in combination with one another.

What is claimed is:

1. A walker comprising:

a frame;

primary hand grips coupled with the frame; and a vertical extension coupled with the frame, wherein the vertical extension comprises a first portion and a second portion comprising a plurality of secondary hand grips extending therefrom and arranged to allow a user to climb the plurality of secondary hand grips of the first and second portions to progressively stand more erect from a walking position; and wherein the plurality of secondary hand grips extend only partially between the first and second portions.

2. The walker of claim 1, further comprising a hand brake positioned by the primary hand grips.

3. The walker of claim 1, wherein the primary hand grips are height adjustable.

4. The walker of claim 1, wherein the plurality of secondary hand grips are height adjustable.

5. The walker of claim 1, wherein the plurality of secondary hand grips are arranged as a plurality of parallel pairs of hand grips.

6. The walker of claim 1, wherein each of the plurality of secondary hand grips is in a different horizontal plane.

7. The walker of claim 1, wherein the vertical extension is integrated in the frame.

8. The walker of claim 1, wherein the vertical extension is removably connected to the frame.

9. The walker of claim 8, further comprising an attachment mechanism for removably connecting the vertical extension to the frame.

10. The walker of claim 1, wherein the vertical extension further comprises a top portion that connects the first and second portions.

11. An accessory for a walker, the accessory comprising a support structure comprising:

a first portion and a second portion; an attachment mechanism configured to secure the support structure to a walker; and a plurality of hand grips extending from the first and second portions and arranged to avow a user of the walker to climb the plurality of hand grips of the first and second portions to progressively stand more erect from a walking position;

wherein the plurality of hand grips extend only partially between the first and second portions.

12. The accessory of claim 11, wherein the plurality of hand grips are positioned along the support structure such that the plurality of hand grips are positioned above primary hand grips of the walker when the support structure is secured to the walker.

13. The accessory of claim 11, wherein the plurality of hand grips are arranged as a plurality of parallel pairs of hand grips.

14. The accessory of claim 11, wherein each of the plurality of hand grips is in a different horizontal plane.

15. The accessory of claim 11, wherein the support structure further comprises a top portion that connects the first and second portions.

16. A walker comprising:

a frame; a pair of primary hand grips coupled with the frame; and means for assisting a user in moving from a walking position in which the user grips the pair of primary hand grips to a more-erect position, wherein the means comprises a vertical extension coupled with the frame comprising a first portion and a second portion and a plurality of secondary hand grips extending therefrom to avow the user to climb the plurality of secondary hand grips of the first and second portions to progressively move to the more-erect position from the walking position; and wherein the plurality of secondary hand grips extend only partially between the first and second portions.

* * * * *